US007950466B2

(12) United States Patent
Rodgers et al.

(10) Patent No.: US 7,950,466 B2
(45) Date of Patent: May 31, 2011

(54) WELLHEAD SYSTEM AND CONNECTOR FOR WELLHEADS

(75) Inventors: Doyle W. Rodgers, Longview, TX (US); Randy P. Nichols, Humble, TX (US); Henry Lang, The Woodlands, TX (US)

(73) Assignee: Stream-Flo Industries Ltd., Edmonton (CA)

( * ) Notice: Subject to any disclaimer, the term of this patent is extended or adjusted under 35 U.S.C. 154(b) by 469 days.

(21) Appl. No.: 12/026,456

(22) Filed: Feb. 5, 2008

(65) Prior Publication Data

US 2008/0185156 A1 Aug. 7, 2008

Related U.S. Application Data

(60) Provisional application No. 60/899,734, filed on Feb. 6, 2007, provisional application No. 60/926,455, filed on Apr. 27, 2007.

(51) Int. Cl.
*E21B 33/03* (2006.01)
*E21B 19/00* (2006.01)

(52) U.S. Cl. ..... 166/379; 166/75.13

(58) Field of Classification Search ..... 166/379, 166/75.13, 382
See application file for complete search history.

(56) References Cited

U.S. PATENT DOCUMENTS

| | | | | |
|---|---|---|---|---|
| 279,086 | A | 6/1883 | Emery | |
| 600,988 | A | 3/1898 | Hayes | |
| 1,367,156 | A * | 2/1921 | McAlvay et al. | 166/75.13 |
| 1,822,444 | A * | 9/1931 | MacClatchie | 285/425 |
| 1,905,592 | A | 4/1933 | Knowlton et al. | |
| 3,248,130 | A | 4/1966 | Knight | |
| 4,090,565 | A * | 5/1978 | McGee | 166/379 |
| 4,762,344 | A | 8/1988 | Perkins et al. | |
| 6,070,912 | A | 6/2000 | Latham | |
| 6,247,537 | B1 | 6/2001 | Dallas | |
| 6,571,877 | B1 | 6/2003 | Bilderbeek | |
| 6,578,876 | B2 | 6/2003 | Guertin, Jr. | |
| 6,688,386 | B2 * | 2/2004 | Cornelssen et al. | 166/65.1 |
| 7,040,410 | B2 | 5/2006 | McGuire et al. | |
| 7,159,652 | B2 | 1/2007 | McGuire et al. | |
| 7,231,983 | B2 * | 6/2007 | Lequang et al. | 166/379 |
| 2004/0163821 | A1 * | 8/2004 | vanBilderbeek | 166/379 |
| 2005/0051362 | A1 | 3/2005 | McGuire et al. | |
| 2005/0145391 | A1 * | 7/2005 | Lequang et al. | 166/380 |
| 2007/0074874 | A1 | 4/2007 | Richardson | |
| 2007/0114039 | A1 * | 5/2007 | Hobdy et al. | 166/379 |
| 2008/0185156 | A1 * | 8/2008 | Rodgers et al. | 166/379 |

OTHER PUBLICATIONS

International Search Report for PCT Application PCT/US2008/053092, Jun. 25, 2008.
"Quick Lock Drilling Flange", from www.wellheadinc.com/Products/quick_lock_wellhead_system.htm, 2 pages.
Seaboard International flyer entitled "Fas-Dril", 1 page.
FMC Technologies brochure "Real-World Innovation—Wellhead and Fracturing Solutions", 8 pages.
FMC Technologies brochure "Drilling Performance—DTO Wellhead Technology", 4 pages.

* cited by examiner

*Primary Examiner* — Jennifer H Gay
(74) *Attorney, Agent, or Firm* — Greenlee Sullivan PC

(57) ABSTRACT

A wellhead system, connector, and method of assembling a wellhead system. The connector includes a member having a set of left-hand threads and a set of right-hand threads on its interior surface. The connector provides a quick connection to threads on wellhead components such as a tubing head and a casing head.

27 Claims, 5 Drawing Sheets

WELLHEAD SYSTEM AND CONNECTOR FOR WELLHEADS

RELATED APPLICATION

This Application claims the benefit, and priority benefit, of U.S. Patent Application Ser. No. 60/899,734, filed Feb. 6, 2007, entitled "Rapid Connector" and 60/926,455, filed Apr. 27, 2007, entitled "Wellhead and Connector for Wellheads".

BACKGROUND OF THE INVENTION

1. Field of the Invention

The invention relates to a wellhead system and a connector for wellheads for use in oilfield wells, and a method for assembling a wellhead system for use in an oilfield well.

2. Description of the Related Art

A typical oilfield well comprises several strings of tubing, such as strings of casing and production tubing. A typical well includes a casing head supporting an outer, or surface, casing string, and a casing hanger may be disposed in the casing head for supporting an inner, or production casing, string. A tubing head is typically disposed above the casing head and the tubing head has disposed therein a tubing hanger which supports a string of production tubing. The production casing string typically extends downwardly into a hydrocarbon bearing formation. Typically, the tubing head is connected to the casing head by some type of connector.

SUMMARY OF THE INVENTION

In accordance with the illustrative embodiments hereinafter described, a wellhead system may comprise a tubing head having an upper end, a lower end, a bore extending from the upper end to the lower end of the tubing head, and a first set of threads disposed on an outer surface of the tubing head; a tubing hanger disposed in the bore of the tubing head; at least one casing head having an upper end, a lower end, a bore extending from the upper end to the lower end of the at least one casing head, and a set of threads disposed on an outer surface of the at least one casing head; a casing hanger disposed in the bore of the at least one casing head; and at least one connector which releasably connects the tubing head to the at least one casing head, the at least one connector including a member having an interior surface which threadedly engages at least a portion of the first and second sets of threads on the tubing head and the casing head, the interior surface of the at least one connector including a set of left-hand threads and a set of right-hand threads.

Further in accordance with the illustrative embodiments hereinafter described, a method for assembling a wellhead system may comprise: providing a tubing head having an upper end, a lower end, a bore extending from the upper end to the lower end of the tubing head, and a first set of threads disposed on an outer surface of the tubing head; providing at least one casing head having an upper end, a lower end, a bore extending from the upper end to the lower end of the casing head, and a second set of threads disposed on an outer surface of the at least one casing head; disposing a casing hanger in the bore of the at least one casing head; providing at least one connector including a member having an interior surface having two sets of threads, wherein one set of threads is a set of left-hand threads and the other set of threads is a set of right-hand threads; and releasably connecting the tubing head to the at least one casing head by threadedly engaging at least a portion of the first set of threads on the tubing head with one of the sets of threads on the at least one connector, and threadedly engaging at least a portion of the second set of threads on the at least one casing head with the other set of threads on the at least one connector.

BRIEF DESCRIPTION OF THE DRAWING

The present wellhead system and connector, and method for assembling a wellhead system may be understood by reference to the following description taken in conjunction with the accompanying drawing, in which.

Figure 1A:
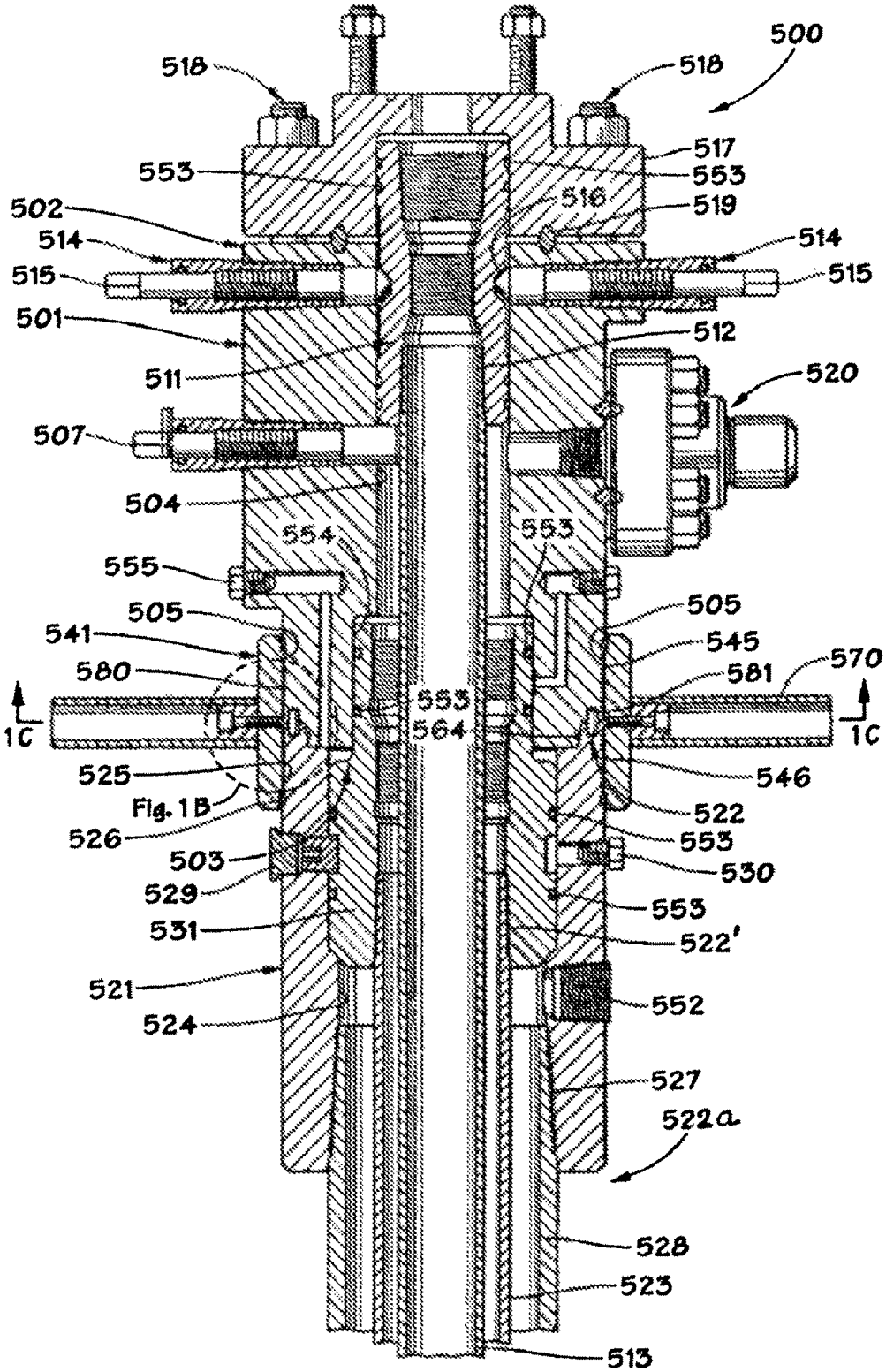
FIG. 1A is a partial cross-sectional view of an illustrative embodiment of the present wellhead system.

While certain embodiments will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF SPECIFIC EMBODIMENTS

Illustrative, specific embodiments of the present wellhead system and method for assembling a wellhead system are described below. The same reference numerals are used throughout this description and in the drawing for components having the same structure, and primed reference numerals are used for components having a similar construction to those elements bearing the same unprimed reference numerals.

Figure 1B:
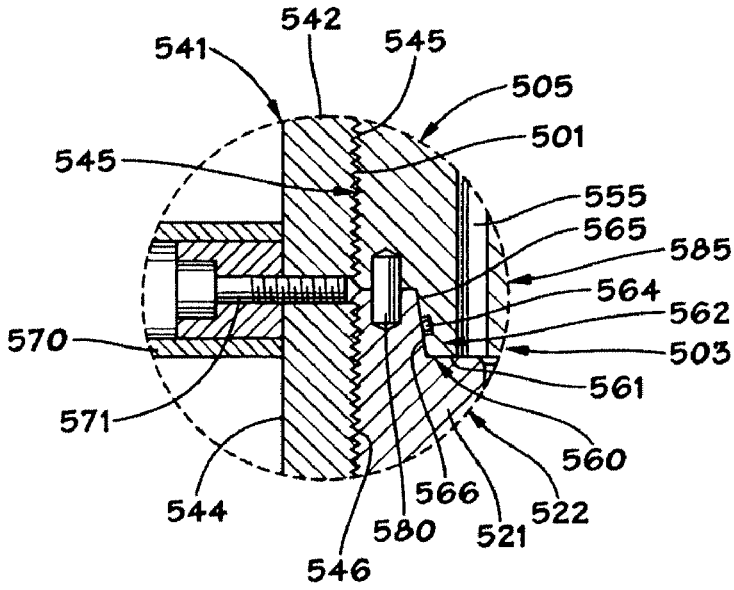
FIG. 1B is an exploded cross-sectional view of a portion of the wellhead system of FIG. 1A within the dotted line circle denoted FIG. 1B in FIG. 1A.
Figure 1C:
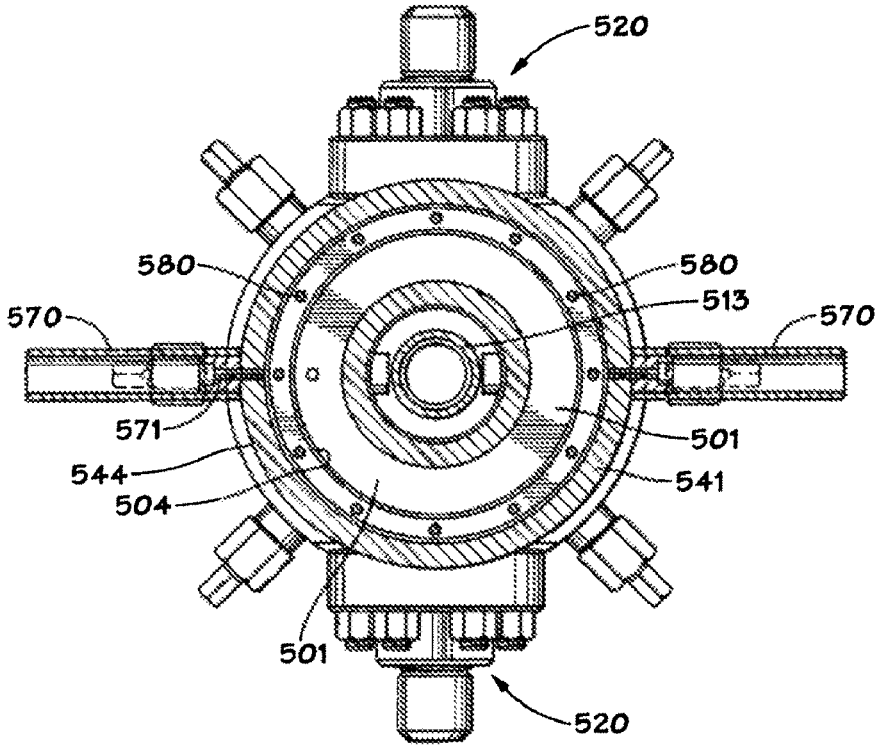
FIG. 1C is a partial cross-sectional view of the wellhead system of FIG. 1A taken along line 1C-1C.

In FIGS. 1A, 1B, and 1C, one illustrative embodiment of the present wellhead system 500 is illustrated. Wellhead system 500 is seen to generally include a tubing head 501, a tubing hanger 511, a casing head 521, a casing hanger 531, and a connector 541, which as hereinafter will be described, releasably connects the tubing head 501 to casing head 521.

Tubing head 501 has a generally annular-shaped cross-sectional configuration, and has an upper end 502, a lower end 503, and a bore 504 extending from the upper end 502 to the lower end 503 of the tubing head 501. A first set of threads 505 is disposed upon an outer surface 506 of tubing head 501, the first set of threads 505 being preferably disposed adjacent the lower end 503 of tubing head 501, as shown in FIGS. 1A and 1B. As will be hereinafter described, the first set of threads 505 is preferably a left-hand set of threads.

Tubing hanger 511 may be of any design compatible with tubing head 501, and is disposed in the bore 504 of the tubing head 501. Tubing hanger 511 at its lower end is provided with a threaded connection, or set of threads, 512 for threadedly receiving the upper end of a length of production tubing 513. A lock screw assembly 514, preferably including a plurality of threaded lock screws 515, may be provided in the tubing head 501 for engagement with a chamfered groove 516 formed in the tubing hanger 511, whereby the tubing hanger 511 may be held in its desired position within tubing head 501. Tubing head 501 may also include a stop pin assembly 507 which may be used to engage the lower end of tubing hanger 511 to assist in its positioning within bore 504 of tubing head 501.

Tubing head 501 may have a tubing adapter 517 disposed above the upper end 502 of tubing head 501, and the tubing adapter 517 may be secured to tubing head 501 as by a plurality of nuts and bolts 518. Tubing head adapter 517 is preferably connected to the tubing head 501 in a sealed manner, as by one or more seals 519, in a conventional manner. As seen in FIGS. 1A and 1C, two studded side outlets 520 may be provided and sealingly secured to tubing head 501, whereby conventional valves, such as gate valves 551 (FIG. 4) may be secured. Studded side outlets 520 are typically in fluid communication with the bore 504 of tubing head 501.

With reference to FIGS. 1A and 1B, casing head 521 is of a generally annular shaped cross-sectional configuration and has an upper end 522, a lower end 522*a*, and a bore 524 extending from the upper end 522 to the lower end 522*a* of the casing head 521. A second set of threads 525 are disposed on an outer surface 526 of the casing head 521, and preferably the second set of threads 525 are disposed adjacent the upper end 522 of the casing head 521. Preferably, the second set of threads 525 are a right-hand set of threads. Casing hanger 531 is disposed in the bore 524 of casing head 521. Casing head 521 is provided with a plurality of threads 522', which threadedly engage with the threads on the upper end of a length of production casing 523. Casing head 521 may also include a set of threads 527 which threadedly engage with a set of threads on the upper end of a length of an outer, or surface, casing 528. Casing head 521 may also be provided with a retaining pin assembly 529 for retaining casing hanger 531 within bore 524 of casing head 521. Additionally, casing head 521 may also include one or more seal test ports 530. Casing head 521 may also include, if desired, a threaded side outlet 552 as shown in FIG. 1A, a plurality of conventional seals 553 may be disposed between the outer surfaces of tubing hanger 511 and casing hanger 531, whereby tubing hanger 511 is disposed within bore 504 of tubing head 501 in a sealed relationship, and casing hanger 531 is disposed in a sealed relationship within bore 524 of casing head 521. In this regard, the seal test ports 530 may be used to test the seal between seals 553 in a conventional manner.

Still with reference to FIG. 1A, the lower end 503 of tubing head 501 may be provided with an internal female recess, or bore, 554, which may receive the upper end of the casing hanger 531 in a sealed relationship as by the seals 553. Tubing head 501 may also include a flange test port 555 which may be used in a conventional manner to test the sealed relationship between the lower end 503 of tubing head 501 with the upper end 522 of casing head 521. In this regard, as better seen in FIG. 1B, a mating connection 560 is provided between the lower end 503 of tubing head 501 and the upper end 522 of casing head 521. Preferably the mating connection 560 is a tapered, mating connection; however, it should be noted that other types of mating connections which are not of a tapered construction could be utilized if desired. The mating connection 560 is preferably provided by a tapered, female recess 561 formed in the upper end 522 of casing head 521, which mates with a male, tapered projection 562 formed at the lower end 503 of tubing head 501. If desired, the location of the female recess 561 and male projection 562 could be reversed, whereby the lower end 503 of tubing head 501 may include the female recess, and the upper end 522 of casing head 521 may be provided with the male projection 562.

As will be hereinafter described, as the tubing head 501 will preferably be stabbed downwardly into the connector 541 and the casing head 521, it is preferred that the mating connection 560 be as shown in FIG. 1B, whereby the tapered surfaces help guide the tubing head 501 into the casing head 521. A seal 564 may be provided between the tubing head 501 and the casing head 521 upon the mating, tapered surfaces 565, 566 of the tapered recess and projection 561, 562. Seal 564 may be any type of seal, such as a conventional elastomeric o-ring or a metal-to-metal seal; however, other types of seals could be utilized. The mating, tapered surfaces 565, 566 thus provide a substantially zero clearance, anti-extrusion area. As previously discussed, instead of having tapered surfaces 565, 566 on the recess and projection 561, 562, those surfaces 565, 566 could be disposed substantially parallel to each other and parallel to the longitudinal axis of the tubing head 501 and casing head 521.

With reference to FIGS. 1A and 1B, connector 541 will be described in greater detail. Connector 541 preferably includes a member 542 having an interior surface 543 which threadedly engages at least a portion of the first and second sets of threads 505, 525, on the tubing head 501 and the casing head 521. The interior surface 543 of connector member, or member, 542, has a generally circular cross-sectional configuration to threadedly mate with the threaded exterior outer wall surfaces of the tubing head 501 and casing head 521. Preferably connector member, or member, 542 is annular shaped, whereby its outer wall surface 544 also has a generally circular cross-sectional configuration; however, it should be noted that the outer cross-sectional configuration of the member 542 could be circular, square, hexagonal, etc. as desired.

The interior surface 543 of member 542 is provided with two sets of threads, 545, 546. One of the sets of threads is a set of left-hand threads, and the other set of threads is a set of right-hand threads. Preferably the upper set of threads 545 is a set of left-hand threads which engage the first set of threads 505 on the tubing head 501, which are also preferably a set of left-hand threads. Similarly, the lower set of threads 546 is a set of right-hand threads which engage the second set of threads 525 on the casing head 521, which are also preferably a set of right-hand threads. Thus, the set of threads 505 on the tubing head 501 may be threadedly received within connector 541 and threadedly engaged with the upper set of threads 545 of connector 541, and the second set of threads 525 of the casing head 521 may be received within connector 541 and threadedly engaged with the lower set of threads 546 of connector 541. It should be readily apparent, that if desired, the first set of threads 505 could be a set of right-hand threads, the upper set of threads 545 could be a set of right-hand threads, the second set of threads 525 of casing head 521 could be a left-hand set of threads, and the lower of threads 546 of connector 541 could also be a left-hand set of threads.

As will be hereinafter described in greater detail, if the sets of threads 505, 545 are sets of left-hand threads, and the sets of threads 525 and 546 are right-hand sets of threads, upon the tubing head 501 and the casing head 521 being initially brought into threaded engagement with connector 541, upon rotation of connector 541 in a right-hand fashion, or in a clockwise direction when viewed from the top of wellhead system 500, the rotation of connector 541, or connector member 542, will cause relative movement of connector 541 with respect to both the tubing head 501 and the casing head 521; and the tubing head 501 and the casing head 521 will be drawn toward each other until they are in the sealed relationship illustrated in FIG. 1B. Similarly, if the first set of threads 505 and the upper set of threads 545 are right-hand sets of threads and the second set of threads 525 and the lower set of threads 546 are each left-hand sets of threads, upon rotation of connector 541 in a left-hand fashion, or in a counterclockwise direction when viewed from the top of wellhead system 500, again the tubing head 501 and casing head 525 will be drawn together into the sealed relationship illustrated in FIG. 1B. In either embodiment, rotation of connector 541 may be provided in any suitable manner, such as by handles 570 which may be threaded into connector 541 as by threaded bolt 571 as shown in FIGS. 1A, 1B, and 1C. Although two handles 570 are illustrated, any number of handles 570, as desired, may be utilized.

With reference to FIGS. 1A and 1B, it is seen that at least one, and preferably a plurality of alignment pins 580 may be disposed between the lower end 503 of tubing head 501 and the upper end 522 of casing head 521. The alignment pins 580 are matingly received within the lower end 503 of the tubing head 501 and the upper end 522 of the casing head 521. Preferably, openings, or receptacles, 581 are drilling into the lower end 503 of tubing head 501 and the upper end 522 of casing head 521 for receipt of the alignment pins 580. The pins 580 may be initially disposed in either the lower end 503 of tubing head 501 or the upper end 522 of casing head 521, and as tubing head 501 is drawn toward casing head 521, the alignment pins 580 will enter a complementary opening, or drilled opening, or receptacle, 581, and will assist in aligning tubing head 501 with respect to casing head 521, as well as provide an anti-rotation mechanism 585 for tubing head 501 and casing head 521. Once the alignment pins 580 are disposed within both openings 581 of the tubing head 501 and casing head 521, relative rotation between tubing head 501 and casing head 521 is prevented. Upon rotation of connector 541, as previously described, tubing head 501 and casing head 521 cannot rotate with respect to each other, but may only move relative to each other in a direction along their longitudinal axes. The anti-rotation mechanism 585 absorbs any tensional forces possibly created during the makeup, or bringing together, of the tubing head 501 and the casing head 521 by the rotation of the connector 541. The connector 541 is only exposed to tension stresses, and any bending stresses are absorbed by the mating connection 560 between the tubing head 501 and the casing head 521.

With reference to FIGS. 1A, 1B, and 1C, the operation of, and method for assembly wellhead system 500 will be described. After casing head 521 has been disposed in a conventional manner along with surface casing 528, in a well, casing hanger 531 may be run into casing head 521 and secured within casing head 521, as by retaining pin assembly 529. As is known in the oilfield well industry, a conventional blowout preventer, not shown, may be utilized. Connector 541 is provided, and is threadedly engaged with the casing head 521, as by lowering connector 541 upon the upper end of casing head 521 and rotating connector 541 about the upper end 522 of casing hanger 521. When, as previously described, the second set of threads 525 on casing head 521 and the lower set of threads 546 of connector 541 are right-hand thread sets, connector 541 is rotated in a right-hand fashion, or clockwise, as viewed from above wellhead system 500. Connector 541 is preferably only rotated a few turns, such as, by way of example only, two right-hand turns, whereby a portion of the lower set of threads 546 of connector 541 are threadedly engaged with a portion of the second set of threads 525 of casing head 521.

Tubing head 501 may then be lowered downwardly and stabbed into connector 541. In this embodiment, as previously described, the first set of threads 505 on the tubing head 501 and the upper set of threads 545 of connector 541 are left-hand sets of threads. Tubing head 501 is then rotated in a left-hand fashion, or counterclockwise when viewed from the top of wellhead system 500. Tubing head 501 is rotated a few turns, such as two left-hand turns, by way of example only. Thus, a portion of the first set of threads 505 are threadedly engaged with a portion of the upper set of threads 545. Tubing head 501 is thus releasably connected to the casing head 521. Upon further rotation in a right-hand fashion of connector 541, tubing head 501 is drawn downwardly toward casing head 521 until the connection between tubing head 501 and casing head 521 is as shown in FIG. 1B. The releasable connection between tubing head 501 and casing head 521 may be unconnected, by rotation of connector 541 in the opposite direction used for makeup, or rotated in a left-hand fashion, whereby tubing head 501 moves away from casing head 521, until the connection is broken. For example, the connector 541 may be rotated 10 right-hand turns, or whatever number of turns are required until tubing head 501 is connected to casing head 521 as shown in FIG. 1B.

As previously described, alignment pins 580 assist in the alignment of tubing head 501 and casing head 521, and alignment pins 580 also provide an anti-rotation mechanism 585 as previously described, whereupon alignment pins 580 being engaged with complementary openings 581 in the tubing head 501 and casing head 521, rotation of tubing head 501 with respect to casing head 521 is prevented while connector 541 is rotated.

After the connection of tubing head 501 is made with casing head 521, as previously described, production tubing 513 may be run into the tubing head 501 in a conventional manner, and tubing hanger 511 may be secured within tubing head 501, as by use of threaded lock screws 515 and stop pin assembly 507, as previously described. Conventional wellhead operations may then be conducted.

Figure 2:
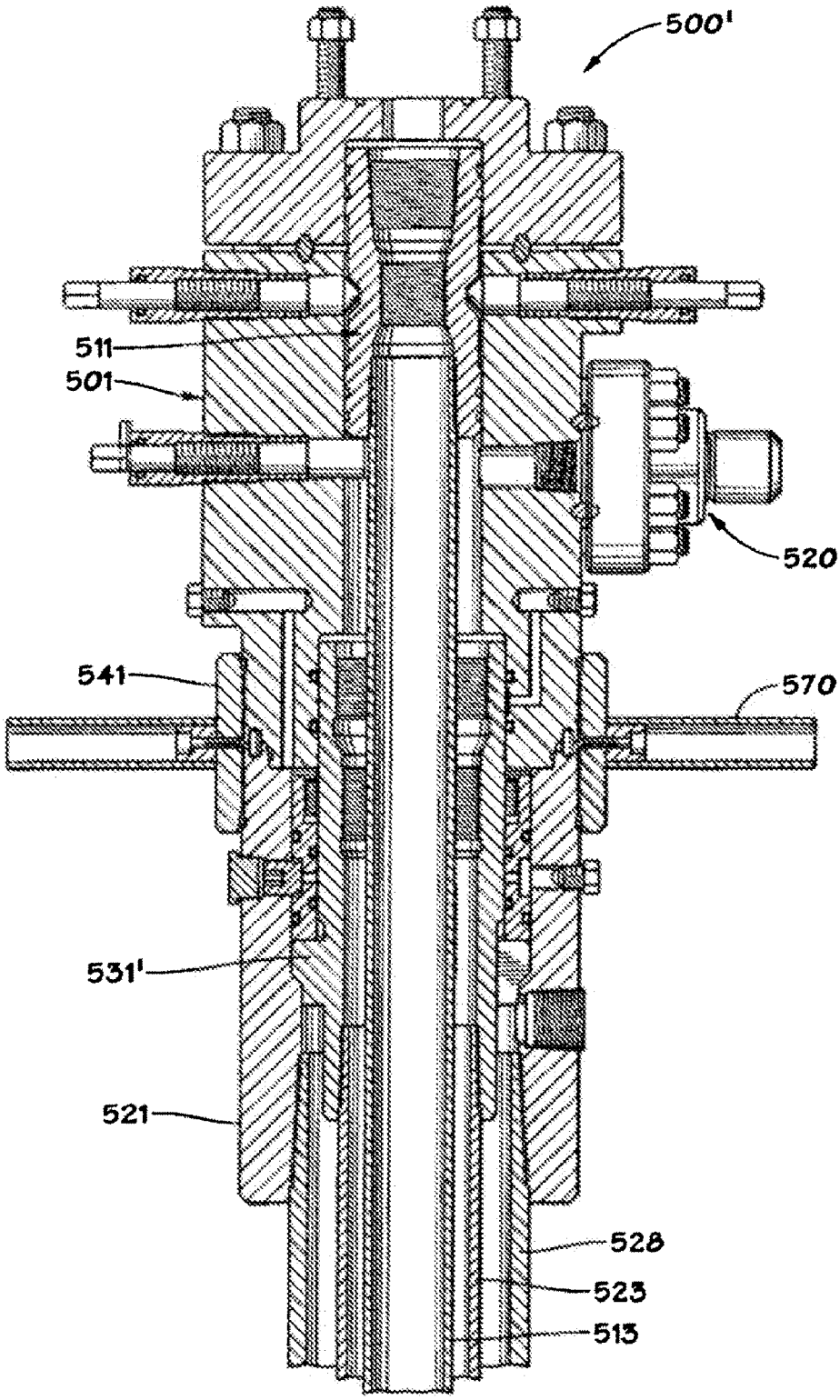
FIG. 2 is a partial cross-sectional view of another illustrative embodiment of the present wellhead system.

With reference to FIG. 2, another illustrative embodiment 500' of the present wellhead system is illustrated. This illustrative embodiment of wellhead 500' only differs from that of the wellhead system 500 of FIGS. 1A, 1B, and 1C, in that casing hanger 531' is a fluted casing hanger, which permits circulation of fluids in wellhead system 500'. Its construction and operation is otherwise substantially the same as that of the illustrative embodiment 500 of FIGS. 1A, 1B, and 1C with respect to the releasable connection between tubing head 501 and casing head 521.

Figure 3:
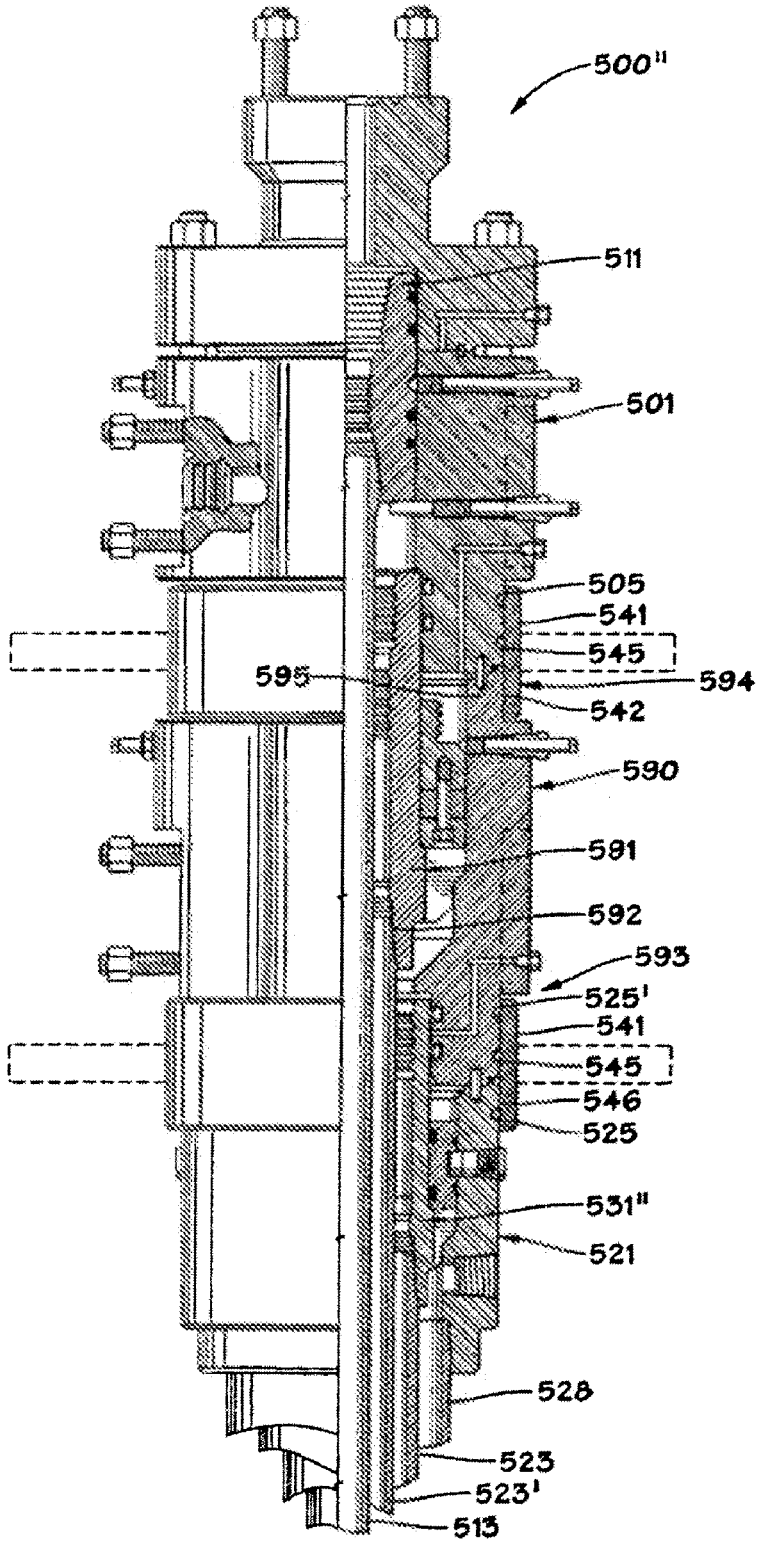
FIG. 3 is a partial cross-sectional view of another illustrative embodiment of the present wellhead system.

With reference to FIG. 3, another illustrative embodiment of a wellhead system 500" is illustrated. FIG. 3 illustrates how multiple wellhead components, as will be hereinafter described, may be releasably secured in series by use of multiple connectors 541. As shown in FIG. 3, in addition to tubing head 501, tubing hanger 511, and casing head 521, as previously described, an intermediate casing head 590 may be disposed between the tubing head 501 and the casing head, or lower casing head, 521 by use of another connector 541. In the embodiment shown of wellhead system 500", the shape of casing hanger 531" is slightly different from that of casing hangers 531 and 531, previously described, but again casing hanger 531" serves to suspend and support production casing 523 from lower casing head 521. Intermediate casing head 590 includes an intermediate casing hanger 591 and the lower end 593 of intermediate casing hanger 591 which is provided with a threaded connection 592 for threadedly receiving the upper end of another length of production casing 523', which has a smaller diameter than the production casing 523. The lower end 593 of intermediate casing head 590 has a set of threads 525' for threaded engagement with the upper set of threads 545 of connector 541, in the same manner as previously described in connection with the embodiment of wellhead system 500 of FIGS. 1A, 1B, and 1C. The upper end 594 of intermediate casing head 590 is similarly provided with a set of threads 595 which are the same as threads 525 disposed upon the upper end of casing head 521 of FIG. 1A. The set of threads 595 are threadedly engaged with the lower set of threads 546 of connector 541, as previously described in connection with FIGS. 1A and 1B. Similarly, the first set of threads 505 of tubing head 501 are threadedly engaged by connector 541 in the same manner as previously described in connection with FIGS. 1A and 1B.

The operation and assembly of the embodiment of wellhead system 500" of FIG. 3 is substantially similar to the assembly of the wellhead system 500 of FIG. 1A. After casing head, or starter head, 521 is run into the well and secured to surface casing 528, casing hanger 531" is installed in casing head 521. A connector 541 is lowered upon casing head 521 and rotated a few turns in the same manner as previously described in connection with the wellhead system 500 of FIG. 1A. Intermediate casing head 590 may then be stabbed into the connector member 541 above casing head 521 and rotated a few turns in the same manner as previously described in connection with wellhead system 500. The connector 541 is thus threadedly engaged with the lower end 593 of intermediate casing head 590 and the upper end 522 of casing head 521. Connector 541 is then rotated until the connection between intermediate casing head 590 and casing head 521 is fully made up. Intermediate casing hanger 591 may then be installed within intermediate casing head 590 to support production casing 523'. The second connector member 541, shown disposed above intermediate casing head 590, is then lowered upon the upper end 594 of intermediate casing head 590, rotated a few turns, and then tubing head 501 is lowered and stabbed into the connector member 541. Connector member 541, disposed between the intermediate casing head 590 and tubing head 501, is then rotated a number of turns until tubing head 501 is drawn downwardly toward intermediate casing head 590 and the connection between tubing head 501 and intermediate casing head 590 is fully made up. As previously described, tubing hanger 511 is then installed to support production tubing 513. In the same manner, as previously described in connection with FIG. 3, additional components, such as additional casing heads and/or tubing heads, or other well components could also be serially connected together as desired.

Figure 4:
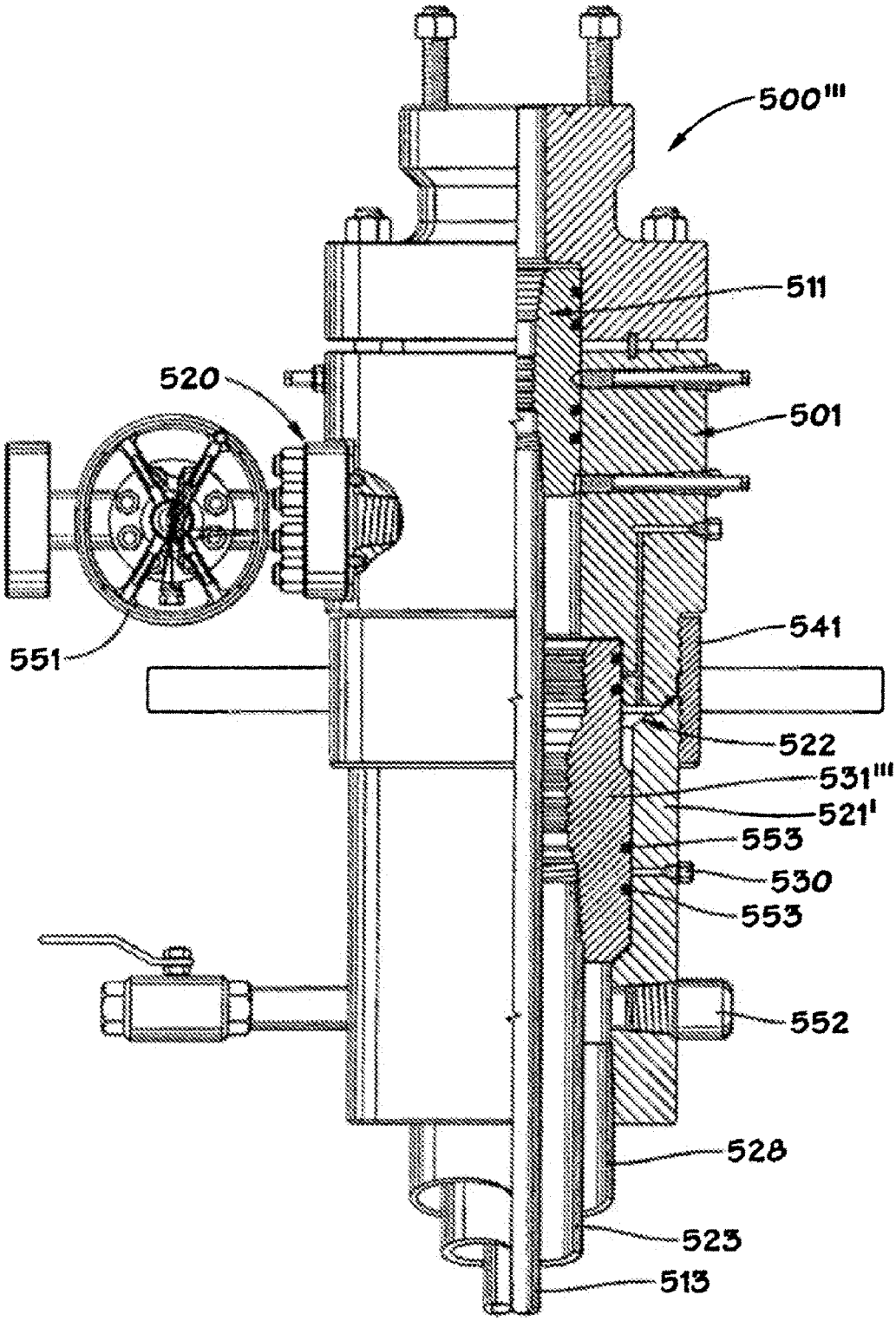
FIG. 4 is a partial cross-sectional view of another illustrative embodiment of the present wellhead system.

With reference to FIG. 4, another illustrative embodiment of a wellhead system 500'" is illustrated. This embodiment of wellhead system 500'" basically differs from that of the embodiment of wellhead system 500 of FIGS. 1A, 1B, and 1C, in that the upper end 522 of casing head 521' has a slightly different configuration, as does casing hanger 531'" in the area between seals 553 disposed above and beneath seal test port 530.

Connector 541, shown and described in connection with the illustrative embodiments of the present wellhead systems 500, 500', 500", and 500'", may also be utilized to provide a quick, simultaneous connection of other tubular shaped components used on wellheads, Christmas trees, or other oilfield well equipment, provided the other components to be releasably connected have a substantially circular, cross-sectional outer configuration, and the sets of threads 505, 525 are provided for threaded engagement with the sets of threads 545, 546 of connector 541. The size of the present connector for use with other oilfield well components may be scaled up or down in size as desired. It should be also noted that in addition to utilizing the present connector 541, for releasably connecting oilfield well components, such as the previously described tubing head and casing heads, connector 541 could also be used to merely connect components in a more permanent fashion, if it is desired that the oilfield well components not be disconnected, or disassembled. All of the previously described components of the present wellhead systems and present connector may be manufactured of any suitable materials having the requisite strength characteristics to function in the manner described for the use of such components, and in the case of seals, such seals may similarly be made of any suitable material having the requisite strength and flexibility characteristics to provide the types of sealing previously described. Lastly, any type of thread profile may be utilized for the previously described sets of threads provided the thread profile permits the sets of threads to be engaged and operate in the manner previously described.

Specific illustrative embodiments of the present invention have been described and illustrated. It will be understood to those skilled in the art that changes and modifications may be made without departing from the spirit and scope of the invention defined by the appended claims.

We claim:

1. A wellhead system, comprising:

a tubing head having an upper end, a lower end, a bore extending from the upper end to the lower end of the tubing head, and a first set of threads disposed on an outer surface of the tubing head;

a tubing hanger disposed in the bore of the tubing head;

at least one casing head having an upper end, a lower end, a bore extending from the upper end to the lower end of the casing head, and a second set of threads disposed on an outer surface of the at least one casing head;

a casing hanger disposed in the bore of the at least one casing head; and at least one connector which releasably connects the tubing head to the at least one casing head, the at least one connector including a member having an interior surface which threadedly engages at least a portion of the first and second sets of threads on the tubing head and the at least one casing head, the interior surface of the at least one connector including a set of left-hand threads and a set of right-hand threads.

2. The wellhead system of claim 1, wherein the member is annular shaped.

3. The wellhead system of claim 1, including at least one alignment pin disposed between the lower end of the tubing head and the upper end of the at least one casing head, the at least one alignment pin being matingly received within the lower end of the tubing head and the upper end of the at least one casing head.

4. The wellhead system of claim 1, including an anti-rotation mechanism for preventing rotation of the tubing head with respect to the at least one casing head upon rotation of the at least one connector.

5. The wellhead system of claim 4, wherein the anti-rotation mechanism includes at least one alignment pin.

6. The wellhead system of claim 1, including a mating connection between the lower end of the tubing head and the upper end of the at least one casing head.

7. The wellhead system of claim 6, wherein the mating connection is a tapered mating connection.

8. The wellhead system of claim 7, wherein the tapered, mating connection has a substantially zero clearance, anti-extrusion area.

9. The wellhead system of claim 1, wherein the casing hanger is a fluted casing hanger.

10. The wellhead system of claim 1, wherein the first set of threads is disposed adjacent the lower end of the tubing head.

11. The wellhead system of claim 1, wherein the second set of threads is disposed adjacent the upper end of the at least one casing head.

12. The wellhead system of claim 1, wherein the at least one casing head is an intermediate casing head and a lower casing head, the intermediate casing head being disposed between the tubing head and the lower casing head.

13. The wellhead system of claim 12, wherein the at least one connector is two connectors, one of which releasably connects the tubing head to the intermediate casing head and the other connector releasably connects the intermediate casing head to the lower casing head.

14. The wellhead system of claim 1, wherein the at least one connector is a single connector which releasably connects the tubing head to a lower casing head.

15. The wellhead system of claim 1, wherein one of the first and second sets of threads is a left-hand set of threads.

16. The wellhead system of claim 15, wherein the first set of threads on the tubing head is a left-hand set of threads.

17. A method for assembling a wellhead system, comprising:

providing a tubing head having an upper end, a lower end, a bore extending from the upper end to the lower end of the tubing head, and a first set of threads disposed on an outer surface of the tubing head;

providing at least one casing head having an upper end, a lower end, a bore extending from the upper end to the lower end of the casing head, and a second set of threads disposed on an outer surface of the at least one casing head;

disposing a casing hanger in the bore of the at least one casing head;

providing at least one connector including a member having an interior surface having two sets of threads, wherein one set of threads is a set of left-hand threads and the other set of threads is a set of right-hand threads; and releasably connecting the tubing head to the at least one casing head by threadedly engaging at least a portion of the first set of threads on the tubing head with one of the sets of threads on the at least one connector and threadedly engaging at least a portion of the second set of threads on the at least one casing head with the other set of threads on the at least one connector.

18. The method of claim 17, including providing at least one alignment pin between the lower end of the tubing head and the upper end of the at least one casing head, and matingly receiving the at least one alignment pin within the lower end of the tubing head and the upper end of the at least one casing head.

19. The method of claim 17, including providing a mating connection between the lower end of the tubing head and the upper end of the at least one casing head.

20. The method of claim 19, including utilizing a tapered, mating connection.

21. The method of claim 20, including providing the tapered, mating connection with a substantially zero clearance, anti-extrusion area.

22. The method of claim 17, including utilizing as the casing hanger a fluted casing hanger.

23. The method of claim 17, including disposing the first set of threads adjacent the lower end of the tubing head.

24. The method of claim 17, including disposing the second set of threads adjacent the upper end of the at least one casing head.

25. The method of claim 17, including utilizing as the at least one casing head an intermediate casing head and a lower casing head, and disposing the intermediate casing head between the tubing head and the lower casing head.

26. The method of claim 25, including utilizing as the at least one connector, two connectors, and releasably connecting the tubing head to the intermediate casing head with one connector and releasably connecting the intermediate casing head to the lower casing head with the other connector.

27. The method of claim 17, including utilizing as the at least one connector, a single connector and releasably connecting the tubing head to the at least one casing head.

* * * * *